US010369444B1

(12) United States Patent
Doucette

(10) Patent No.: US 10,369,444 B1
(45) Date of Patent: Aug. 6, 2019

(54) GOLF CHIPPING GAME

(71) Applicant: Christopher Doucette, East Lynn, MA (US)

(72) Inventor: Christopher Doucette, East Lynn, MA (US)

( * ) Notice: Subject to any disclaimer, the term of this patent is extended or adjusted under 35 U.S.C. 154(b) by 0 days.

(21) Appl. No.: 15/921,166

(22) Filed: Mar. 14, 2018

(51) Int. Cl.
*A63B 57/40* (2015.01)
*A63B 63/08* (2006.01)

(52) U.S. Cl.
CPC ..... *A63B 63/08* (2013.01); *A63B 57/40* (2015.10)

(58) Field of Classification Search
CPC ..... A63B 69/36; A63B 67/02
See application file for complete search history.

(56) References Cited

U.S. PATENT DOCUMENTS

| | | | | |
|---|---|---|---|---|
| 1,679,374 | A | 8/1928 | Reirden | |
| 3,464,704 | A | 9/1969 | Nelson | |
| 3,843,136 | A | 10/1974 | Buenzle | |
| 4,017,084 | A | 4/1977 | Jeffery | |
| 4,203,604 | A | 5/1980 | La Grange | |
| 4,244,576 | A * | 1/1981 | Mosier | A63B 67/02 273/DIG. 30 |
| 4,966,370 | A | 10/1990 | Morris | |
| D347,661 | S | 6/1994 | Dickson | |
| 5,725,438 | A | 3/1998 | Dennesen | |
| 7,258,621 | B2 | 8/2007 | McDuffee | |
| 8,376,871 | B1 | 2/2013 | Cloud | |
| 8,608,584 | B1 * | 12/2013 | Cobb | A63B 69/3641 473/218 |
| 2009/0149266 | A1 * | 6/2009 | Castano | A63B 67/02 473/160 |
| 2017/0291083 | A1 * | 10/2017 | Smith | A63B 67/02 |

* cited by examiner

*Primary Examiner* — Eugene L Kim
*Assistant Examiner* — Christopher A Glenn

(57) ABSTRACT

A golf chipping game includes a target that is positioned on a horizontal support surface such as ground or the like. The target has a plurality of apertures therein for receiving a golf ball and the target slopes upwardly from the horizontal support surface. A mat is positioned on the horizontal support surface and a user stands on the mat. The mat has a plurality of tee apertures therein for receiving a golf tee thereby facilitating a golf ball to be struck from the golf tee towards the target. Additionally, the mat is spaced a selected distance from the target corresponding to a desired level of difficulty. A plurality of golf clubs is included and a plurality of golf balls is included. Each of the golf balls is struck toward the target for passing the golf balls through the apertures in the target.

9 Claims, 4 Drawing Sheets

GOLF CHIPPING GAME

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to golf games and more particularly pertains to a new golf game for hitting golf balls at a sloped target on the ground with holes therein for scoring.

BRIEF SUMMARY OF THE INVENTION

An embodiment of the disclosure meets the needs presented above by generally comprising a target that is positioned on a horizontal support surface such as ground or the like. The target has a plurality of apertures therein for receiving a golf ball and the target slopes upwardly from the horizontal support surface. A mat is positioned on the horizontal support surface and a user stands on the mat. The mat has a plurality of tee apertures therein for receiving a golf tee thereby facilitating a golf ball to be struck from the golf tee towards the target. Additionally, the mat is spaced a selected distance from the target corresponding to a desired level of difficulty. A plurality of golf clubs is included and a plurality of golf balls is included. Each of the golf balls is struck toward the target for passing the golf balls through the apertures in the target.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
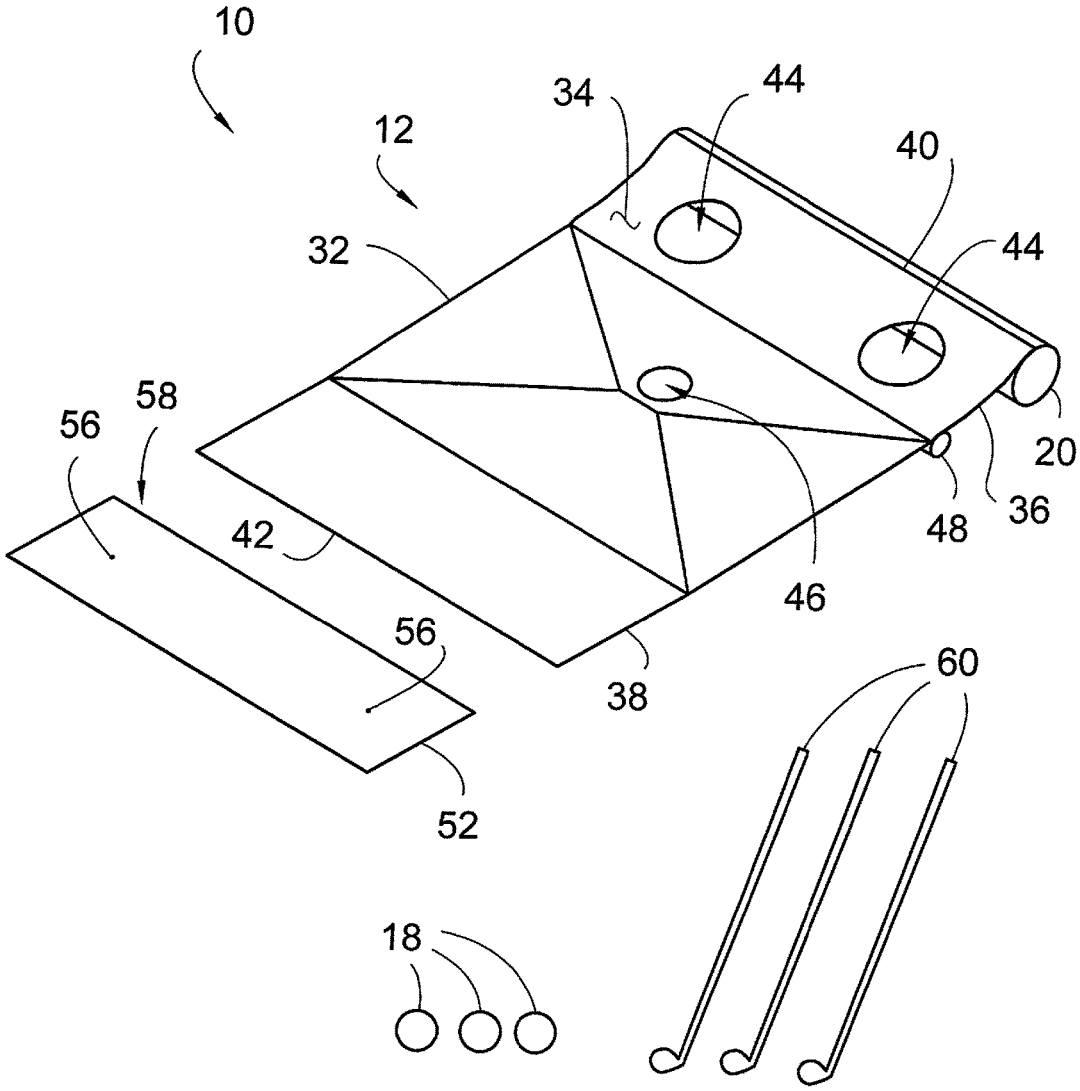
FIG. 1 is a perspective view of a golf chipping game according to an embodiment of the disclosure.
Figure 2:
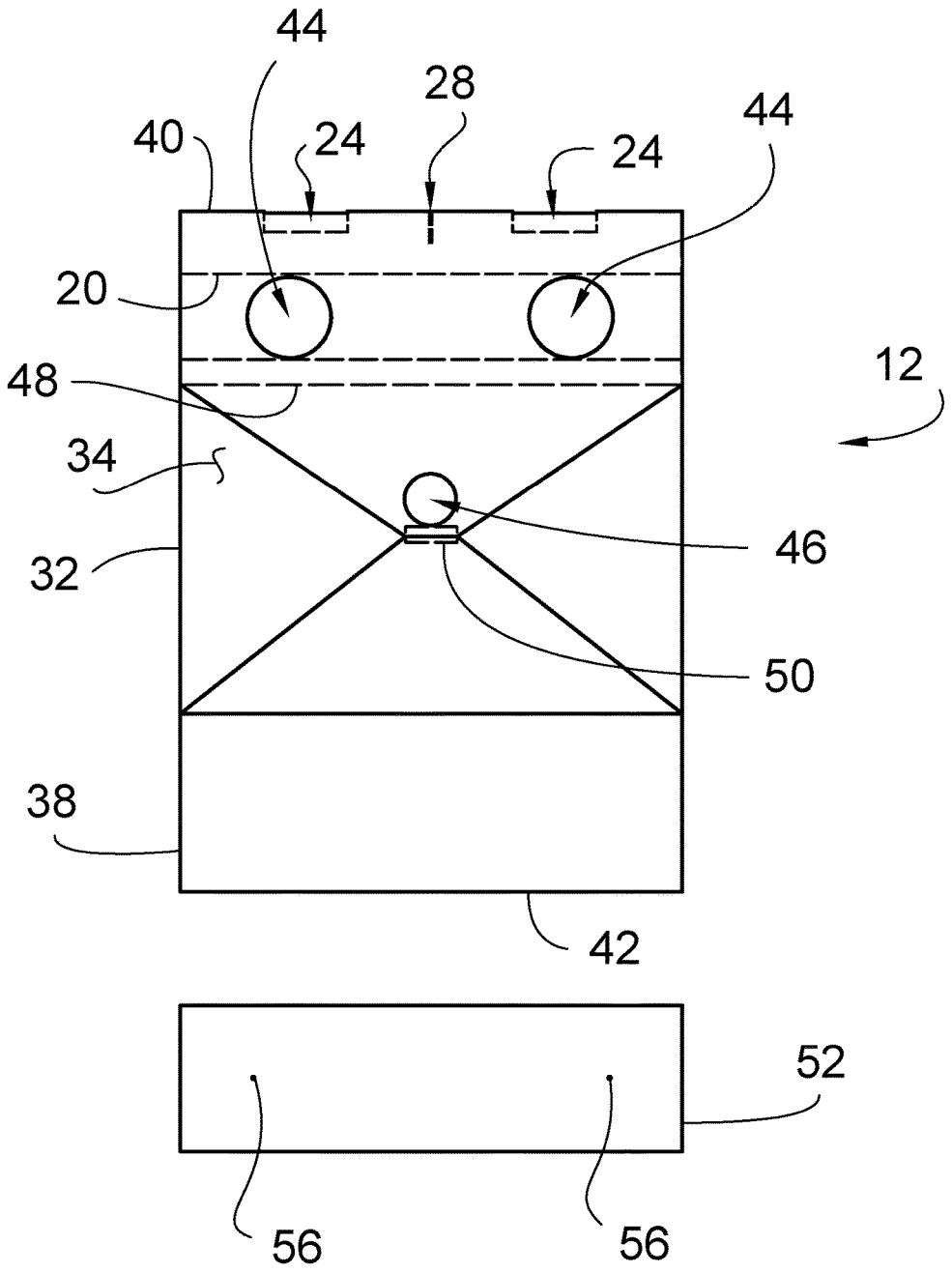
FIG. 2 is a top phantom view of an embodiment of the disclosure.
Figure 3:
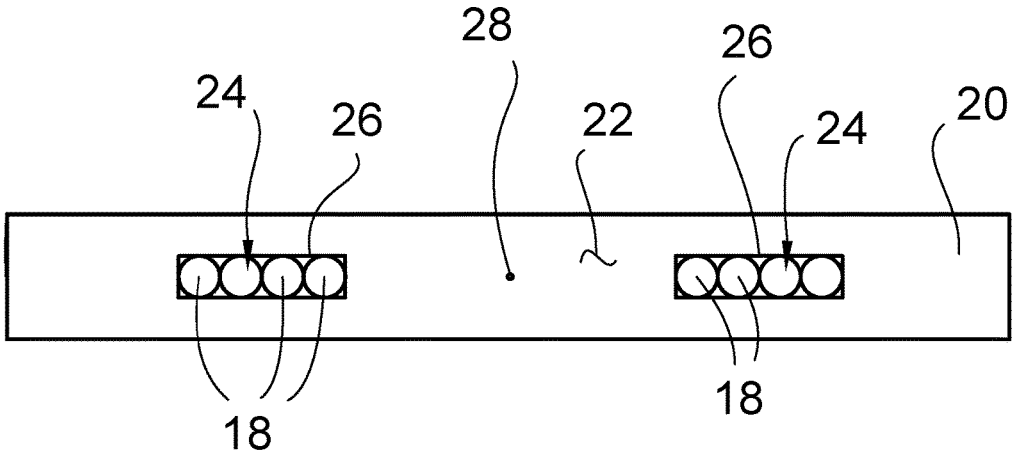
FIG. 3 is a front view of a target of an embodiment of the disclosure.
Figure 4:
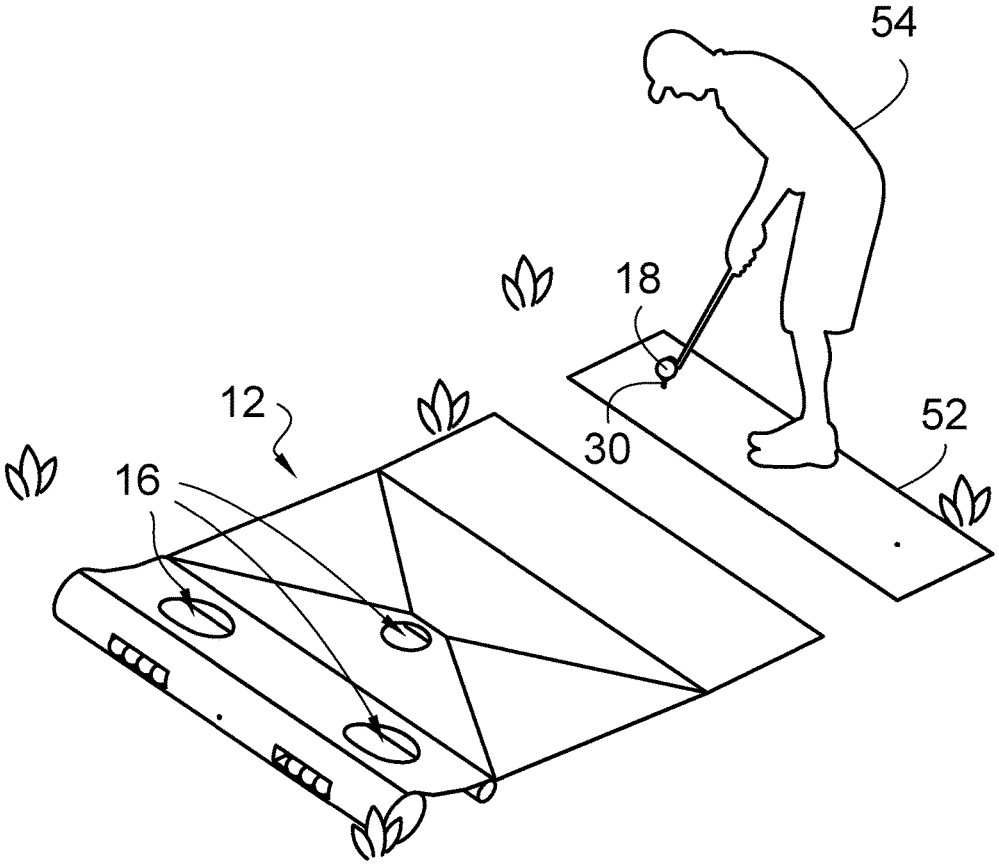
FIG. 4 is a perspective in-use view of an embodiment of the disclosure.

With reference now to the drawings, and in particular to FIGS. 1 through 4 thereof, a new golf game embodying the principles and concepts of an embodiment of the disclosure and generally designated by the reference numeral 10 will be described.

As best illustrated in FIGS. 1 through 4, the golf chipping game 10 generally comprises a target 12 that is positioned on a horizontal support surface 14 such as ground or the like. The target 12 has a plurality of apertures 16 therein for receiving a golf ball 18. Additionally, the target 12 slopes upwardly from the horizontal support surface 14. Thus, the golf ball 18 will roll downwardly on the target 12 when the golf ball 18 lands on the target 12.

The target 12 comprises a first tube 20 that has an outer surface 22 and the first tube 20 is positioned on the horizontal support surface 14. The outer surface 22 has a plurality of wells 24 extending into the first tube 20. The wells 24 are spaced apart from each other and are distributed along the first tube 20. The plurality of wells 24 may include a plurality of rectangular storage wells 26 and a tee well 28 for insertably receiving a golf tee 30. Additionally, the first tube 20 may have a length ranging between approximately 115.0 cm and 130.0 cm and a diameter of at least 15.0 cm. Additionally, the tube may be comprised of a resiliently compressible material such as foam rubber or the like.

The target 12 includes a blanket 32 that has a first surface 34, a second surface 36 and a peripheral edge 38 extending therebetween. The peripheral edge 38 has a front side 40 and a back side 42, and the front side 40 is attached to the outer surface 22 of the first tube 20. Moreover, the front side 40 extends along an entire length of the first tube 20. The front side 40 of the blanket 32 is elevated from the horizontal support surface 14 when the first tube 20 is positioned on the horizontal support surface 14. Thus, the blanket 32 slopes downwardly between the front side 40 and the back side 42 with the back side 42 lying on the horizontal support surface 14. Additionally, the blanket 32 is selectively rolled around the first tube 20 for transportation and for storage.

Each of the apertures 16 extends through the first surface 34 and the second surface 36 of the blanket 32. The plurality of apertures 16 includes a set of first apertures 44 and a second aperture 46. The first apertures 44 are spaced from the front side 40 of the blanket 32 and the first apertures 44 are spaced apart from each other and are distributed along the front side 40. Each of the first apertures 44 may have a diameter of approximately 20.0 cm. The second aperture 46 is spaced from the first apertures 44 and the second aperture 46 is centrally positioned between the first apertures 44. Additionally, the second aperture 46 may have a diameter of approximately 13.0 cm.

A second tube 48 is attached to the second surface 36 of the blanket 32 and the second tube 48 lies on the horizontal support surface 14. The second tube 48 is spaced from the first tube 20 and the second tube 48 is oriented to be co-extensive with the first tube 20. The second tube 48 has a diameter that is less than a diameter of the first tube 20. Thus, the second tube 48 retains the downward slope of the blanket 32 between the first tube 20 and the second tube 48 when the first tube 20 and the second tube 48 are positioned on the horizontal support surface 14. The second tube 48 is positioned between the first apertures 44 and the second aperture 46. Additionally, the second tube 48 may have a diameter of approximately 6.0 cm.

A third tube 50 is attached to the second surface 36 of the blanket 32 and the third tube 50 lies on the horizontal support surface 14. The third tube 50 is spaced from the second tube 48 and the third tube 50 is oriented co-linear with the second tube 48. The third tube 50 has a diameter that is less than a diameter of the second tube 48. Thus, the third tube 50 retains the downward slope of the blanket 32 between the second tube 48 and the third tube 50 when the second tube 48 and the third tube 50 are positioned on the horizontal support surface 14. The third tube 50 is aligned with the second aperture 46 and the third tube 50 may have a length of less than approximately 13.0 cm. Thus, the blanket 32 will deform when the golf ball 18 passes along side the third tube 50 thereby increasing difficulty of getting the golf ball 18 in the second aperture 46.

A mat 52 is provided and the mat 52 is positioned on the horizontal support surface 14 for having a user 54 stand thereon. The mat 52 has a plurality of tee apertures 56 therein for receiving a golf tee 30 thereby facilitating a golf ball 18 to be struck from the golf tee 30 towards the target 12. Additionally, the mat 52 is spaced a selected distance from the target 12. The mat 52 has a top surface 58 and each of the tee apertures 56 extends downwardly through the top surface 58. Moreover, the tee apertures 56 are spaced apart from each other on the mat 52 to accommodate left-handed users 54 and right-handed users 54.

A plurality of golf clubs 60 is included and each of the golf clubs 60 is employed to strike a golf ball 18. The golf clubs 60 may be rented golf clubs, golf clubs owned by player and any other type of golf club. Each of the golf clubs 60 is assigned to a player and each of the golf clubs 60 may be short distance golf clubs 60, such as putters and chippers or the like. A plurality of golf balls 18 is provided and each of the golf balls 18 is assigned to a player. The golf balls 18 may be rented golf balls, golf balls provided each of the players or any other similar size and type of ball. Each of the golf balls 18 is struck toward the target 12 for passing the golf balls 18 through the apertures 16 in the target 12. Additionally, each of the golf balls 18 is stored in a selected one of the wells 24 in the first tube 20.

In use, the blanket 32 and the first 20, second 48 and third 50 tubes are laid out on the ground having the blanket 32 sloping downwardly between the third tube 50 and the back side 42 of the blanket 32. The mat 52 is positioned on the ground and the mat 52 is spaced a selected distance from the blanket 32 corresponding to a desired level of difficulty. A golf tee 30 is inserted into a selected one of the tee apertures 56 in the mat 52 and a golf ball 18 is struck from the tee toward the target 12. A score of 3.0 points is awarded when the golf ball 18 passes through either of the first apertures 44 and a score of 5.0 points is awarded when the golf ball 18 passes through the second aperture 46. Additionally, a score of 1.0 point is awarded when the golf ball 18 strikes the blanket 32. Each player takes four shots per round of scoring, and the first player to reach a total of 21.0 points wins the game.

With respect to the above description then, it is to be realized that the optimum dimensional relationships for the parts of an embodiment enabled by the disclosure, to include variations in size, materials, shape, form, function and manner of operation, game and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf chipping game for practicing hitting golf balls into a plurality of holes, said game comprising:

a target being positioned on a horizontal support surface, said target having a plurality of apertures therein for receiving a golf ball, said target sloping upwardly from the horizontal support surface, said target comprising a first tube having an outer surface, said first tube being positioned on the horizontal support surface, said outer surface having a plurality of wells extending into said first tube, each of said wells being spaced apart from each other and being distributed along said first tube;

a mat being positioned on the horizontal support surface wherein said mat is configured to have a user stand thereon, said mat having a plurality of tee apertures therein for receiving a golf tee thereby facilitating a golf ball to be struck from the golf tee towards said target, said mat being spaced a selected distance from said target;

a plurality of golf clubs, each of said golf clubs being employed to strike a golf ball, each of said clubs being assigned to a player; and a plurality of golf balls, each of said golf balls being assigned to a player, each of said golf balls being struck toward said target for passing said golf balls through said apertures in said target, each of said golf balls being stored in a selected one of said wells in said first tube.

2. The game according to claim 1, further comprising a blanket having a first surface, a second surface and a peripheral edge extending therebetween, said peripheral edge having a front side, said front side being attached to said outer surface of said first tube having said front side extending along an entire length of said first tube, said front side of said blanket being elevated from the horizontal support surface when said first tube is positioned on the horizontal support surface, said blanket being selectively rolled around said first tube for storage.

3. The game according to claim 2, wherein each of said apertures extends through said first surface and said second surface of said blanket, said plurality of apertures including a set of first apertures and a second aperture, said first apertures being spaced from said front side of said blanket, said first apertures being spaced apart from each other and being distributed along said front side first surface, said second aperture being spaced from said first apertures and being centrally positioned between said first apertures.

4. The game according to claim 3, further comprising a second tube being attached to said second surface of said blanket wherein said second tube lies on the horizontal support surface, said second tube being oriented to be co-extensive with said first tube.

5. The game according to claim 4, wherein said second tube has a diameter being less than a diameter of said first tube such that said blanket slopes downwardly between said first tube and said second tube when said first tube and said second tube are positioned on the horizontal support surface, said second tube being positioned between said first apertures and said second aperture.

6. The game according to claim 5, further comprising a third tube being attached to said second surface of said blanket wherein said third tube lies on the horizontal support surface, said third tube being oriented co-linear with said second tube.

7. The game according to claim 6, wherein said third tube has a diameter being less than a diameter of said second tube such that said blanket slopes downwardly between said second tube and said third tube when said second tube and said third tube are positioned on the horizontal support surface, said third tube being aligned with said second aperture.

8. The game according to claim 1, wherein said mat has a top surface, each of said tee apertures extending downwardly through said top surface, said tee apertures being spaced apart from each other on said mat to accommodate left-handed users and right-handed users.

9. A golf chipping game for practicing hitting golf balls into a plurality of holes, said game comprising:

a target being positioned on a horizontal support surface, said target having a plurality of apertures therein for receiving a golf ball, said target sloping upwardly from the horizontal support surface, said target comprising:

a first tube having an outer surface, said first tube being positioned on the horizontal support surface, said outer surface having a plurality of wells extending into said first tube, each of said wells being spaced apart from each other and being distributed along said first tube;

a blanket having a first surface, a second surface and a peripheral edge extending therebetween, said peripheral edge having a front side, said front side being attached to said outer surface of said first tube having said front side extending along an entire length of said first tube, said front side of said blanket being elevated from the horizontal support surface when said first tube is positioned on the horizontal support surface, said blanket being selectively rolled around said first tube for storage, each of said apertures extending through said first surface and said second surface of said blanket, said plurality of apertures including a set of first apertures and a second aperture, said first apertures being spaced from said front side of said blanket, said first apertures being spaced apart from each other and being distributed along said first surface, said second aperture being spaced from said first apertures and being centrally positioned between said first apertures;

a second tube being attached to said second surface of said blanket wherein said second tube lies on the horizontal support surface, said second tube being oriented to be co-extensive with said first tube, said second tube having a diameter being less than a diameter of said first tube such that said blanket slopes downwardly between said first tube and said second tube when said first tube and said second tube are positioned on the horizontal support surface, said second tube being positioned between said first apertures and said second aperture; and a third tube being attached to said second surface of said blanket wherein said third tube lies on the horizontal support surface, said third tube being oriented co-linear with said second tube, said third tube having a diameter being less than a diameter of said second tube such that said blanket slopes downwardly between said second tube and said third tube when said second tube and said third tube are positioned on the horizontal support surface, said third tube being aligned with said second aperture;

a mat being positioned on the horizontal support surface wherein said mat is configured to have a user stand thereon, said mat having a plurality of tee apertures therein for receiving a golf tee thereby facilitating a golf ball to be struck from the golf tee towards said target, said mat being spaced a selected distance from said target, said mat having a top surface, each of said tee apertures extending downwardly through said top surface, said tee apertures being spaced apart from each other on said mat to accommodate left-handed users and right-handed users;

a plurality of golf clubs, each of said golf clubs being employed to strike a golf ball, each of said clubs being assigned to a player; and a plurality of golf balls, each of said golf balls being assigned to a player, each of said golf balls being struck toward said target for passing said golf balls through said apertures in said target, each of said golf balls being stored in a selected one of said wells in said first tube.

* * * * *